US005228263A

United States Patent [19]

Vaughn

[11] Patent Number: 5,228,263

[45] Date of Patent: Jul. 20, 1993

[54] T-BAR PARTITION SUPPORT CLIP

[76] Inventor: James Vaughn, 60 Winchester Cr. S.W., Calgary, Alberta T3C-2U1, Canada

[21] Appl. No.: 745,868

[22] Filed: Aug. 16, 1991

[51] Int. Cl.[5] ..... E04C 2/38

[52] U.S. Cl. ..... 52/714; 52/238.1; 52/715

[58] Field of Search ..... 52/238.1, 243, 243.1, 52/484, 714, 715, 238.1

[56] References Cited

U.S. PATENT DOCUMENTS

| | | | |
|---|---|---|---|
| 1,846,723 | 2/1932 | Hamsher | 52/238.1 |
| 3,757,485 | 9/1973 | Vincens | 52/238.1 |
| 4,073,108 | 2/1978 | Williams | 52/238.1 |
| 4,209,953 | 7/1980 | Wendt . | |
| 4,995,209 | 2/1991 | Cobb | 52/238.1 |

FOREIGN PATENT DOCUMENTS

| | | |
|---|---|---|
| 886258 | 11/1971 | Canada . |
| 1010215 | 5/1977 | Canada . |
| 1110031 | 10/1981 | Canada . |
| 1209776 | 8/1986 | Canada . |

*Primary Examiner*—Carl D. Friedman
*Assistant Examiner*—Christopher T. Kent
*Attorney, Agent, or Firm*—Jerry T. Kearns

[57] ABSTRACT

A T-bar partition support clip for securing a rectangular channel shaped partition track to a T-bar ceiling support includes first and second spaced, parallel, vertical leg portions formed from a deformable sheet metal material. Upper ends of the first and second vertical leg portions are perpendicularly connected to coplanar first and second horizontal leg portions. The first and second horizontal leg portions are connected by a vertically extending clip portion possessing vertical sidewalls connected by a top web. A pair of juxtaposed inwardly extending protuberances are formed by punch indentations in central regions of the vertical sidewalls. The vertical sidewalls converge inwardly and downwardly from a maximum lateral separation adjacent the web to a minimum lateral separation adjacent junctions of the vertical sidewalls with the first and second horizontal leg portions. In use the clip portion is inserted over a top ridge of a T-bar ceiling support with the protuberances in engagement with a reduced neck portion of the T-bar ceiling support. Free ends of the vertical leg portions are manually deformed around sidewalls of the partition track to secure the track to the T-bar support. The support clip allows the operation to be rapidly and inexpensively performed without tools and without marring the surface finish of the T-bar ceiling support.

17 Claims, 3 Drawing Sheets

T-BAR PARTITION SUPPORT CLIP

BACKGROUND OF THE INVENTION

The present invention relates to T-bar partition support clips, and more particularly pertains to an improved T-bar partition support clip designed for use with conventional T-bar ceiling supports. In a conventional construction method, a ceiling support grid is formed by suspending a plurality of T-bar supports by wires and positioning ceiling panels in the open spaces between the T-bar supports. The present invention is directed to an improved clip and associated method for mounting a partition channel track for use in erecting partition walls in conjunction with this conventional construction method.

SUMMARY OF THE INVENTION

In order to achieve these and other objects of the invention, the present invention provides an improved T-bar partition support clip for securing a rectangular channel shaped partition track to a T-bar ceiling support which includes first and second spaced, parallel, vertical leg portions formed from a deformable sheet metal material. Upper ends of the first and second vertical leg portions are perpendicularly connected to coplanar first and second horizontal leg portions. The first and second horizontal leg portions are connected by a vertically extending clip portion possessing vertical sidewalls connected by a top web. A pair of juxtaposed inwardly extending protuberances are formed by punch indentations in central regions of the vertical sidewalls. The vertical sidewalls converge inwardly and downwardly from a maximum lateral separation adjacent the web to a minimum lateral separation adjacent junctions of the vertical sidewalls with the first and second horizontal leg portions. In use the clip portion is inserted over a top ridge of a T-bar ceiling support with the protuberances in engagement with a reduced neck portion of the T-bar ceiling support. Free ends of the vertical leg portions are manually deformed around sidewalls of the partition track to secure the track to the T-bar support. The support clip allows the operation to be rapidly and inexpensively performed without tools and without marring the surface finish of the T-bar ceiling support.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
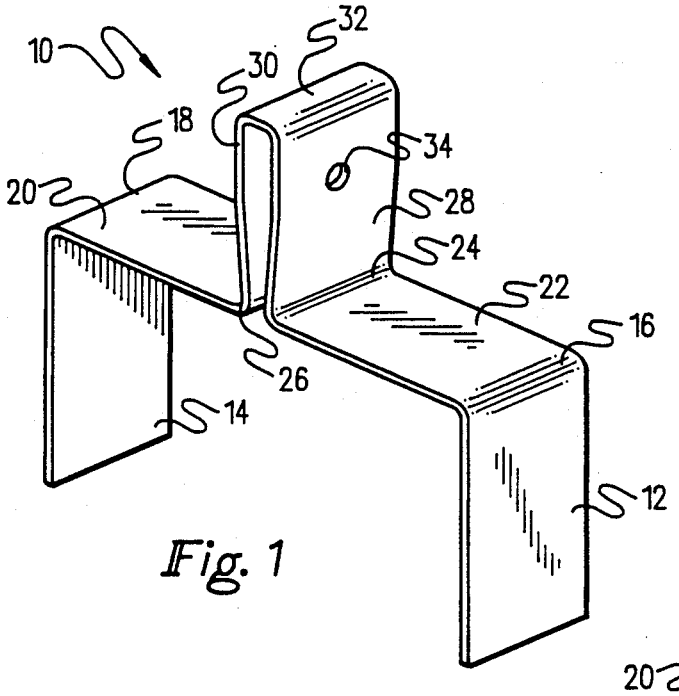
FIG. 1 is a perspective view of the T-bar partition support clip according to the first embodiment of the present invention.

Referring now to the drawings, wherein like reference numerals designate corresponding structure throughout the views, and referring in particular to FIG. 1, an improved T-bar partition support clip 10 according to a first preferred embodiment of the invention includes a first 12 and second 14 parallel vertical leg portions. Upper ends of the leg portions 12 and 14 are respectively perpendicularly connected to coplanar first 22 and second 20 horizontal leg portions by respective radiused right angle bends 16 and 18. A vertically extending clip portion includes vertical sidewalls 28 and 30 which are respectively joined to inner ends of the horizontal leg portions 22 and 20 by radiused right angle bends 24 and 26. A radiused bend top web 32 connects upper ends of the sidewalls 28 and 30, forming a bight portion. As can be appreciated from 1, 2 and 3, a pair of juxtaposed inwardly extending protuberances 34 and 36 are formed in central regions of the sidewalls 28 and 30. The protuberances are generally circular in shape and are preferably formed by partially punching out a circular portion of the central region of the sidewalls 28 and 30. The sidewalls 28 and 30 converge inwardly and downwardly from a maximum lateral separation adjacent the web 32 to a minimum lateral separation adjacent junctions 24 and 26 of the vertical sidewalls with the first 22 and second 20 horizontal leg portions.

Figure 3:
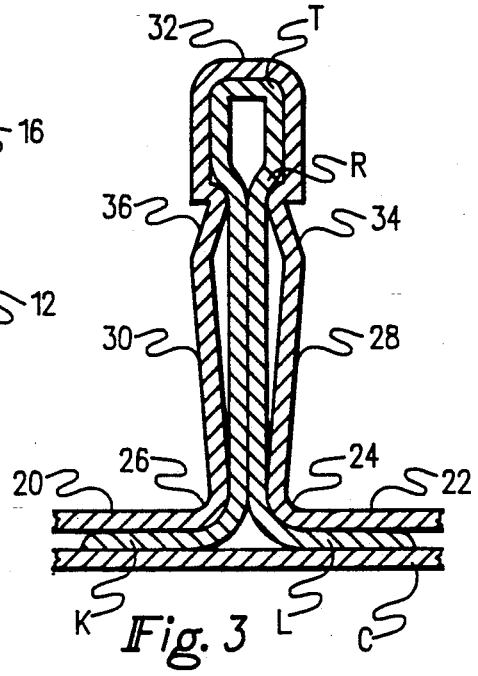
FIG. 3 is a transverse cross-sectional view, taken along line 3—3 of FIG. 2, illustrating the T-bar partition support clip of the present invention in engagement with a T-bar ceiling support.
Figure 2:
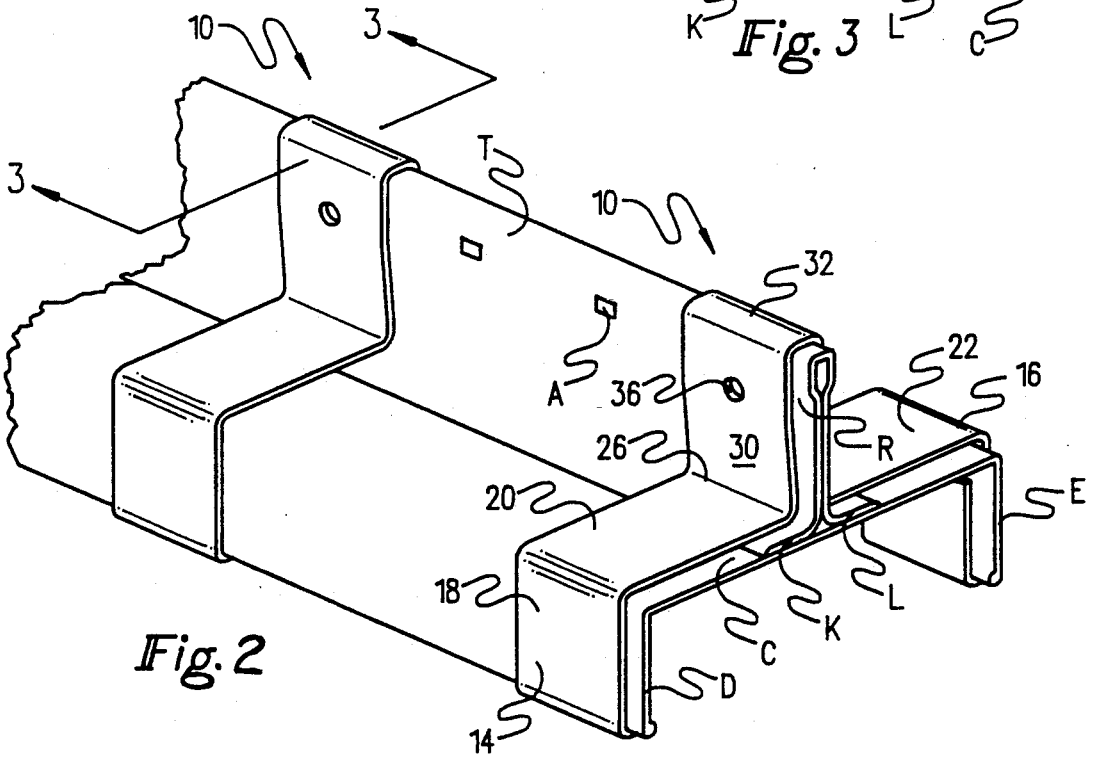
FIG. 2 is a perspective view illustrating the T-bar partition support clips of the present invention in an installed condition, securing a partition track to a T-bar ceiling support.
Figure 4:
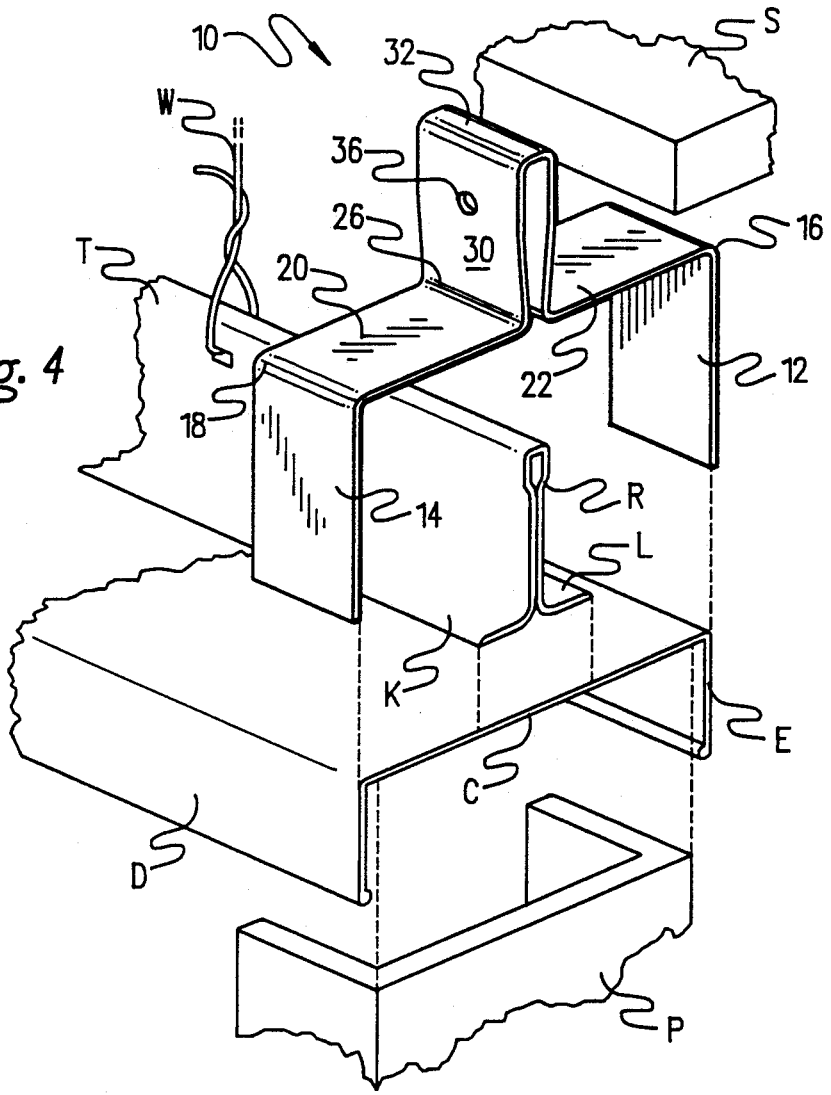
FIG. 4 is an exploded perspective view illustrating the T-bar partition support clip of the present invention in conjunction with conventional T-bar ceiling support, partition track, ceiling panel and partition stud construction components.
Figure 7:
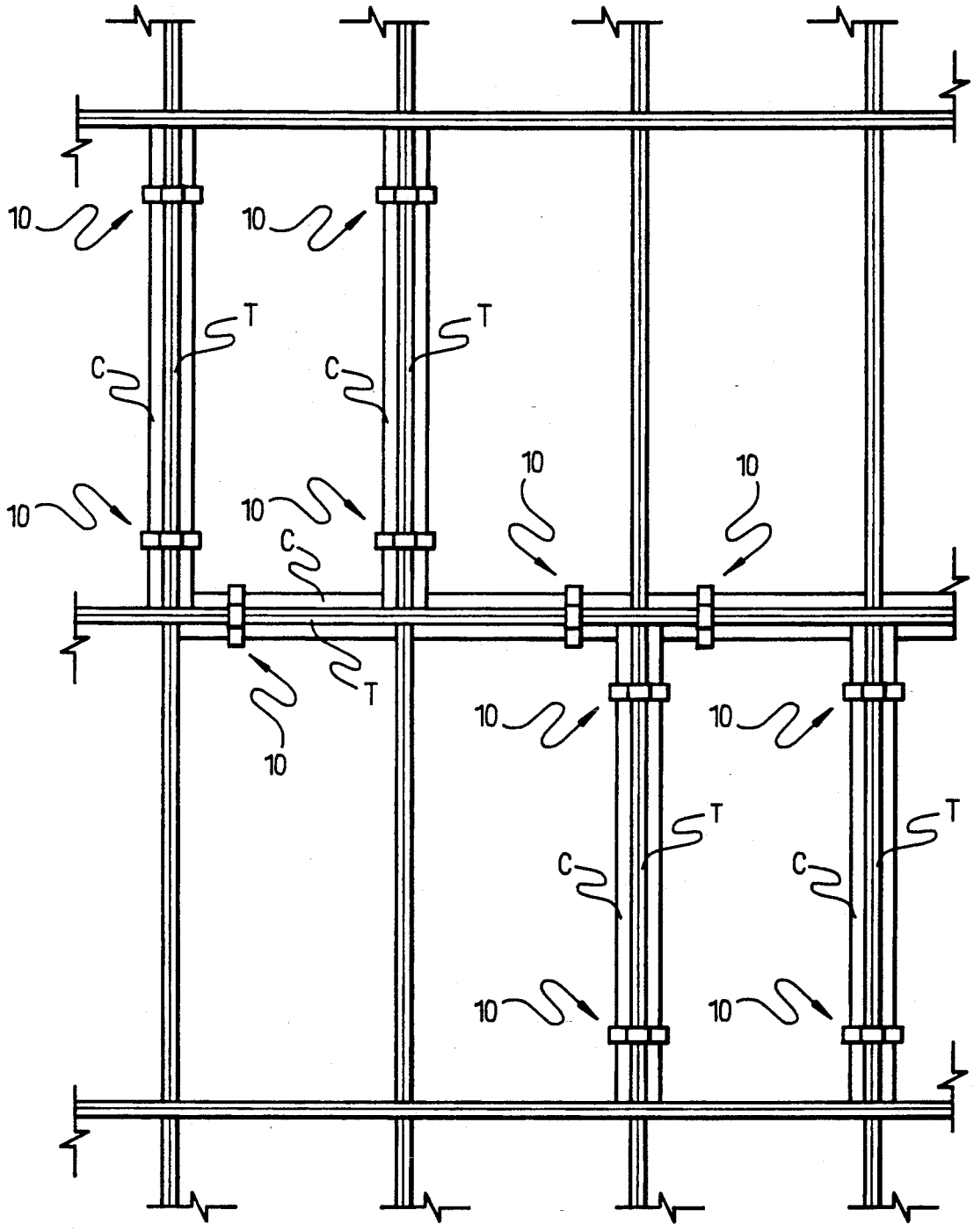
FIG. 7 is a top plan view illustrating the T-bar support clip of the present invention employed in a suspended ceiling grid.

With reference to FIGS. 2, 3 and 4, a conventional method of construction involves the use of an elongated T-bar ceiling support T. The T-bar support T includes a vertical portion having an enlarged width top rib tapering to a reduced neck portion R and terminating in oppositely extending transverse flanges K and L. The T-bar support is provided with a plurality of apertures A adapted to receive wires W for suspending the T-bar support in the construction of a suspended ceiling. As depicted in FIG. 7, a plurality of the T-bar support members are conventionally secured in a grid pattern in the course of construction of a ceiling. Conventionally, ceiling panels S are then supported upon the flanges K and L to cover the rectangular or square open spaces in the grid pattern between the T-bar supports T.

Figure 5:
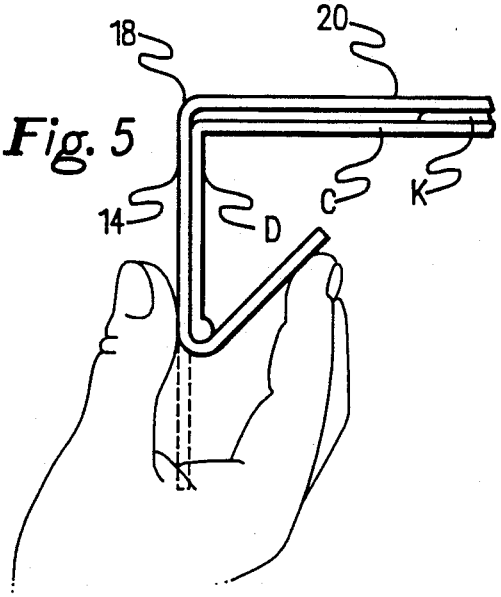
FIG. 5 is an end elevational view illustrating the manner of installing the T-bar partition support clip of the present invention.
Figure 6:
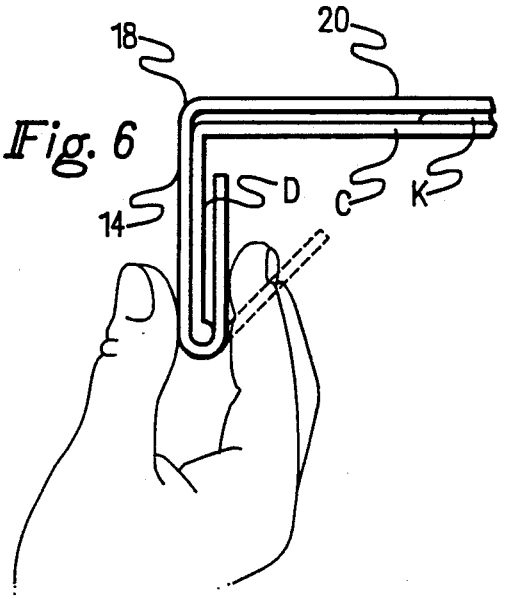
FIG. 6 is an end elevational view, further illustrating the manner of manually installing the T-bar partition support clip of the present invention.

The present invention contemplates utilizing a plurality of clips 10 to secure a partition track C having a rectangular channel configuration to the T-bar supports T. The partition track C has a downwardly opening rectangular opening bounded by sidewalls D and E. As may be understood with reference to FIGS. 2–6, the clip 10 is initially inserted over the vertical portion of the T-bar support T such that the protuberances 34 and 36 engage the reduced neck portion R. The tapering resilient sidewalls 28 and 30 form a frictional clamp which engages the T-bar support. The vertical leg portions 12 and 14 closely overlie the sidewalls D and E of the partition track C, and the horizontal leg portions 20 and 22 overlie the flanges K and L as well as the upper surface of the partition track C. As shown in FIGS. 5 and 6, the lower free end portions of the vertical legs 12 and 14 are then manually bent around the partition track sidewalls D and E to secure the partition track C to the T-bar support T, in the manner shown in FIG. 2.

It should be noted that the clip 10 is preferably integrally formed from a manually deformable sheet metal material, such as aluminum or other suitable metal. The partition track C is then available for use to mount vertically extending partition studs P for use in forming room walls. The securement method and clip of the present method is particularly advantageous due to low cost, rapid installation without tools and easy removal without marring the T-bar supports T. This allows lower cost remodeling of existing installations. Additionally, once the clips 10 are installed on the T-bar supports T, they resist all upward and lateral pressures, without displacement, resulting from subsequent positioning and securement of the partition tracks C.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A T-bar partition support clip, for use with a T-bar ceiling support possessing a vertical portion with an enlarged width top ridge tapering to a reduced neck portion and terminating in two oppositely extending horizontal flanges, said support clip comprising:

first and second spaced, substantially vertical leg portions formed from a deformable material;

upper ends of said first and second vertical leg portions connected to first and second substantially horizontal leg portions;

said first and second horizontal leg portions connected by a clip portion;

said clip portion having laterally spaced resilient sidewalls connected by a top web;

said sidewalls terminating in respective functions with said first and second horizontal leg portions;

a pair of juxtaposed inwardly extending protuberances formed in said sidewalls, said protuberances dimensioned and disposed for engagement with the reduced neck portion of the T-bar ceiling support; and said sidewalls converging inwardly and downwardly from a maximum lateral separation adjacent said web to a minimum lateral separation adjacent junctions of said sidewalls with said first and second horizontal leg portions, said sidewalls dimensioned for frictional clamping engagement with the vertical portion of the T-bar ceiling support, whereby the support clip may be manually inserted without tools over the vertical portion of the T-bar ceiling support and secured thereto by frictional clamping engagement of said sidewalls with the vertical portion of the T-bar ceiling support and engagement of said protuberances with the reduced neck portion of the T-bar ceiling support.

2. The T-bar partition support clip of claim 1, wherein said clip is formed from a manually deformable sheet metal material.

3. The T-bar partition support clip of claim 1, wherein said clip is formed from a manually deformable sheet metal material.

4. The T-bar partition support clip of claim 3, wherein said sheet metal is about 25 gauge.

5. The T-bar partition support clip of claim 1, wherein said vertical leg portions are substantially parallel.

6. The T-bar partition support clip of claim 1, wherein said horizontal leg portions are substantially coplanar.

7. The T-bar partition support clip of claim 1, wherein said vertical leg portions extend substantially perpendicularly to said horizontal leg portions.

8. The T-bar partition support clip of claim 1, wherein said protuberances are formed in central regions of said sidewalls.

9. The T-bar partition support clip of claim 1, wherein said protuberances comprise inward indentations in said sidewalls.

10. The T-bar partition support clip of claim 1, wherein said sidewalls extend substantially vertically.

11. The T-bar partition support of claim 1, wherein said protuberances comprise substantially circular indentations in said sidewalls.

12. A T-bar partition support clip, for use with a T-bar ceiling support possessing a vertical portion with an enlarged width top ridge tapering to a reduced neck portion and terminating in two oppositely extending horizontal flanges, said support clip comprising:

first and second spaced, substantially parallel, substantially vertical leg portions formed from a deformable metal material;

upper ends of said first and second vertical leg portions substantially perpendicularly connected to substantially coplanar first and second substantially horizontal leg portions;

said first and second horizontal leg portions connected by a substantially vertically extending clip portion;

said clip portion having laterally spaced, resilient, substantially vertical sidewalls connected by a top web;

said sidewalls terminating in respective junctions with said first and second horizontal leg portions;

a pair of juxtaposed inwardly extending protuberances formed in central regions of said vertical sidewalls; and said vertical sidewalls converging inwardly and downwardly from a maximum lateral separation adjacent said web to a minimum lateral separation adjacent said junctions of said vertical sidewalls with said first and second horizontal leg portions, said sidewalls dimensioned for frictional clamping engagement with the vertical portion of the T-bar ceiling support, whereby the support clip may be manually inserted without tools over the vertical portion of the T-bar ceiling support and secured thereto by frictional clamping engagement of said sidewalls with the vertical portion of the T-bar ceiling support and engagement of said protuberances with the reduced neck portion of the T-bar ceiling support.

13. The T-bar partition support clip of claim 12, wherein said protuberances comprise inward indentations in said sidewalls.

14. The T-bar partition support clip of claim 12, wherein said protuberances comprise substantially circular inward indentations in said sidewalls.

15. The T-bar partition support clip of claim 12, wherein said clip is formed from a manually deformable sheet metal material.

16. The T-bar partition support clip of claim 15, wherein said sheet metal is about 25 gauge.

17. A method of securing a partition track having a rectangular channel configuration to a T-bar ceiling support including a vertical portion having an enlarged width top rib tapering to a reduced neck portion and terminating in oppositely extending transverse flanges, comprising the steps of:

providing a support clip including:

first and second spaced, substantially parallel, substantially vertical leg portions formed from a deformable metal material;

upper ends of said first and second vertical leg portions substantially perpendicularly connected to substantially coplanar first and second substantially horizontal leg portions;

said first and second horizontal leg portions connected by a substantially vertically extending clip portion;

said clip portion having laterally spaced, resilient, substantially vertical sidewalls connected by a top web;

said sidewalls terminating in respective junctions with said first and second horizontal leg portions;

a pair of juxtaposed inwardly extending protuberances formed in central regions of said vertical sidewalls; and said vertical sidewalls converging inwardly and downwardly from a maximum lateral separation adjacent said web to a minimum lateral separation adjacent said junctions of said vertical sidewalls with said first and second horizontal leg portions;

inserting said clip portion of said support clip over said top rib of said T-bar ceiling support such that said web abuts said top rib and said inwardly extending protuberances are in engagement with said reduced neck portion of said T-bar ceiling support, said vertical sidewalls of said clip are in engagement with said vertical portion of said T-bar ceiling support, and said first and second horizontal leg portions of said support clip overlie said transverse flanges;

positioning said partition track below and in abutment with said transverse flanges of said T-bar ceiling support, said first and second horizontal leg portions overlying said partition track, and said first and second vertical leg portions extending in substantially parallel, closely adjacent relation with sidewalls of said partition track; and manually deforming free end portions of said first and second vertical leg portions around said sidewalls of said partition track, thereby securing said partition track to said T-bar ceiling support.

* * * * *